US005191710A

United States Patent [19]

Fujimaki et al.

[11] Patent Number: 5,191,710

[45] Date of Patent: Mar. 9, 1993

[54] METHOD OF FORMING AN ELECTRODE UNIT

[75] Inventors: Hirohiko Fujimaki; Kazuhito Sano, both of Shizuoka, Japan

[73] Assignee: Yazaki Corporation, Tokyo, Japan

[21] Appl. No.: 815,181

[22] Filed: Dec. 31, 1991

[30] Foreign Application Priority Data

Jan. 8, 1991 [JP] Japan ..... 3-11554

[51] Int. Cl.[5] ..... H01R 43/04

[52] U.S. Cl. ..... 29/863; 29/860; 174/15.7; 219/91.2; 219/91.23; 219/117.1; 439/502; 439/874; 439/883

[58] Field of Search ..... 439/502, 874, 875, 883; 219/91.2, 91.23, 117.1, 119; 29/860, 863; 174/15.7

[56] References Cited

U.S. PATENT DOCUMENTS

| | | | |
|---|---|---|---|
| 4,317,277 | 3/1982 | Bennett et al. | 29/860 |
| 4,394,533 | 7/1983 | Naito | 174/15.7 X |
| 4,640,982 | 2/1987 | Kasper et al. | 219/117.1 X |
| 4,799,899 | 1/1989 | Endo | 439/502 |
| 5,025,554 | 6/1991 | Dohi | 29/860 |

FOREIGN PATENT DOCUMENTS

| | | |
|---|---|---|
| 53-98992 | 8/1978 | Japan . |
| 57-188273 | 11/1982 | Japan . |
| 59-99366 | 7/1984 | Japan . |
| 60-72177 | 4/1985 | Japan . |
| 62-77880 | 5/1987 | Japan . |
| 63-198275 | 8/1988 | Japan . |
| 64-10513 | 1/1989 | Japan . |
| 2-106684 | 8/1990 | Japan . |

*Primary Examiner*—Carl J. Arbes

*Attorney, Agent, or Firm*—Sughrue, Mion, Zinn, Macpeak & Seas

[57] ABSTRACT

A forming electrode unit for forming the conductors of the electric wire into the terminal includes a female pressing electrode having an electric wire housing groove, and a male pressing electrode having an electric wire pressing portion which is fitted in the groove in such a manner that a clearance is defined between the pressing portion and the female pressing electrode. To form the conductors together into the terminal, the conductors are set in the groove, and thereafter pressed by the pressing portion as an electrical current is caused to flow through the electrodes and the conductors to heat the conductors. The electric wire is thus integrally provided with the solidly formed terminal.

15 Claims, 5 Drawing Sheets

METHOD OF FORMING AN ELECTRODE UNIT

BACKGROUND OF THE INVENTION

This invention relates to an electrode unit for integrally forming the conductors of an electric wire into a terminal, and relates to a terminal-formed electric wire.

FIG. 7 is a perspective view of a conventional keyhole-shaped terminal 19 and an electric wire 20 connected therewith. A procedure of connecting the terminal 19 and the wire 20 with each other is now described with reference to FIGS. 8(A), 8(B) and 8(C). The conductors 22 of the electric wire 20 are first set inside a pair of calked parts 21 provided on the straight portion of the terminal 19. The calked parts 21 are then pressed by an anvil 24 having a curved top 23, and a crimper 26 having two grooves 25, so that the calked parts are shaped in conformity with the forms of the grooves. The calked parts 21 are thus curved inward more into pressure contact with the conductors 22 of the wire 20 so that the terminal and the wire are electrically and mechanically coupled with each other.

However, if the conductors 22 are made of a metal different from that for the calked parts 21 or there are oxide films on the conductors or the calked parts, the electric contact resistance between them is so high that an electricity loss is caused or/and the electric coupling lacks long-period stability. This is a problem.

To solve the above-mentioned problem, electric wires 27 integrally formed with a terminal 28 as shown in FIG. 9 were proposed by the present applicant in Japanese Unexamined Utility Model Application No. 77880/87. The conductors 29 of the electric wires 27 are bundled and formed together at one end of each of them to constitute the terminal 28. However, it is difficult to form the numerous thin conductors 29 together solidly into the terminal 28. This is a problem. Therefore, a means for easily and surely forming an electric wire with a terminal has been desired.

SUMMARY OF THE INVENTION

The present invention was made in consideration of the above-mentioned circumstances. Accordingly, it is an object of the invention to provide a forming means for easily and surely forming the conductors of an electric wire into a terminal.

The forming means is an electrode unit including a grooved pressing electrode having an electric wire housing groove, and a protuberant pressing electrode having an electric wire pressing portion which is fitted in the groove in such a manner that a clearance is defined between the pressing portion and the grooved pressing electrode.

A guide pin for bending the electric wire on the pin may be erected in the electric wire housing groove at the center thereof. The conductors of the electric wire are then set in the groove around the guide pin. The conductors are thereafter pressed by the electric wire pressing portion of the protuberant pressing electrode as an electrical current is caused to flow through both the electrodes of the unit and the conductors to heat them, so that the conductors are formed together into the flat annular terminal. The electric wire is thus integrally formed with the terminal.

Since the conductors of the electric wire are heated on the electrodes of the forming electrode unit so as to be softened, the conductors can be easily and surely formed together into the terminal through the pressing thereof with the electrodes.

DETAILED DESCRIPTION OF THE PREFEERED EMBODIMENTS

Figure 1:
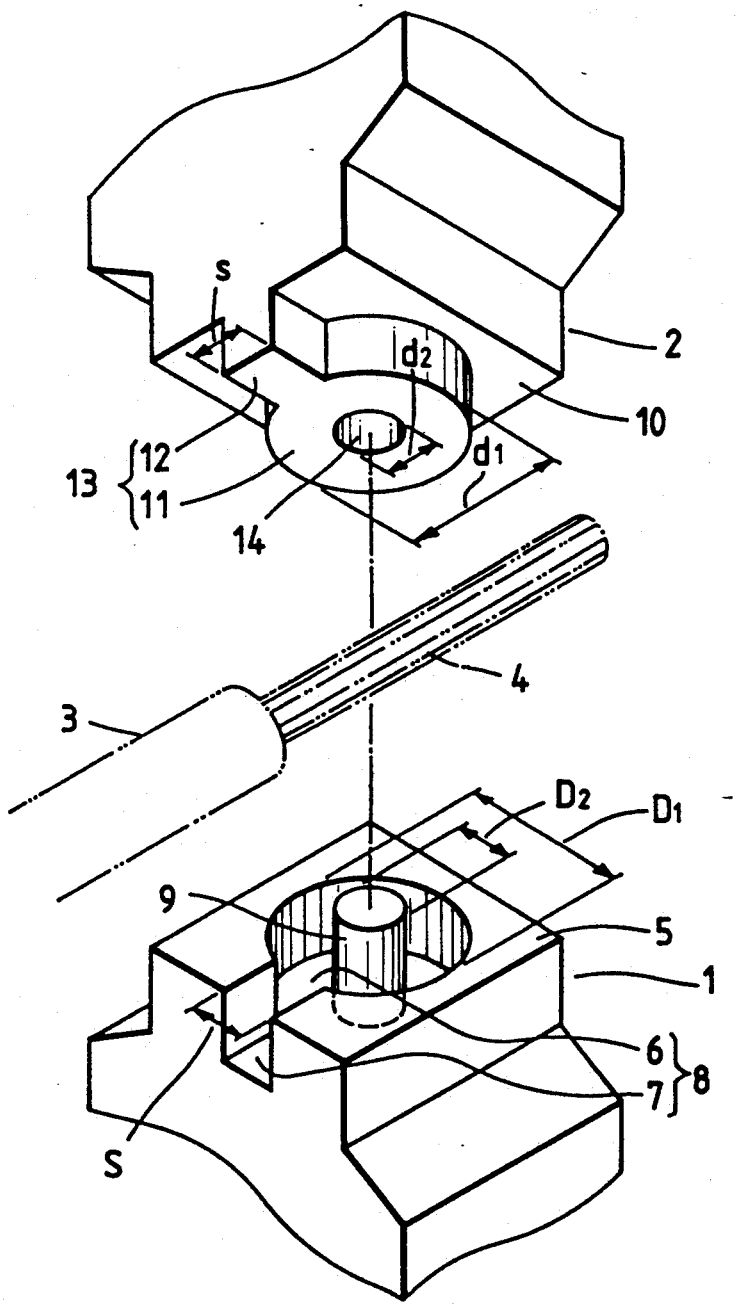
FIG. 1 is a perspective view of a forming electrode unit which is an embodiment of the present invention.

FIG. 1 is a perspective view of a forming electrode unit which is an embodiment of the present invention and is for forming an electric wire 3 with a terminal. The electrode unit includes a female grooved pressing electrode 1 made of tungsten or the like, and a male protuberant pressing electrode 2 made of tungsten or the like. The tip portion 5 of the female grooved pressing electrode 1 has a keyhole-shaped groove 8 consisting of an annular portion 6 and a straight portion 7 to house the exposed conductors 4 of the electric wire 3. A guide pin 9 for bending the exposed conductors 4 on the pin is integrally erected on the tip portion 5 of the female grooved pressing electrode 1 at the center of the groove 8. The tip portion 10 of the male protuberant pressing electrode 2 has an electric wire pressing portion 13 consisting of an annular portion 11 and a straight portion 12 and corresponding to the electric wire housing groove 8. The annular portion 11 has an insertion hole 14 into which the guide pin 9 is inserted. The outside diameter $d_1$ of the annular portion 11 of the pressing portion 13 is smaller than the outside diameter $D_1$ of the annular portion 6 of the groove 8. The width s of the straight portion 12 of the pressing portion 13 is smaller than that S of the straight portion 7 of the groove 8. The diameter $d_2$ of the insertion hole 14 is larger than that $D_2$ of the guide pin 9. As a result, the pressing portion 13 can be fitted in the groove 8 in such a manner that a clearance is defined between the pressing portion and the tip portion 5 of the female grooved pressing electrode 1.

Figure 2:
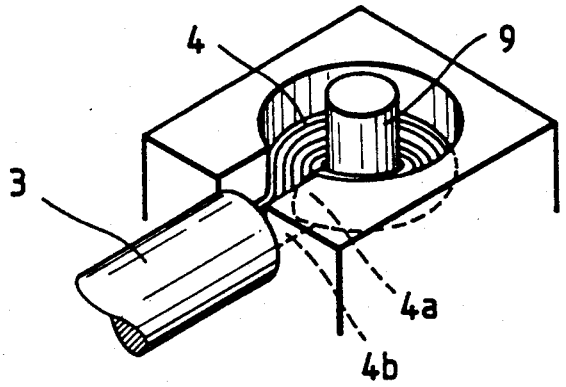
FIG. 2 is a perspective view of the female grooved pressing electrode of the unit in the state that an electric wire is set in the electrode.

When the conductors 4 of the electric wire 3 are to be formed together into the terminal by the electrode unit, the conductors are set in the wire housing groove 8 in such a manner that the conductors are wound on the guide pin 9, and the ends 4*a* of the exposed portions of the conductors are overlaid on the other ends 4*b* of the portions, as shown in FIG. 2. The ends 4*a* may not be overlaid on the other ends 4*b*, to provide a cutoff opening in the terminal.

Figure 3:
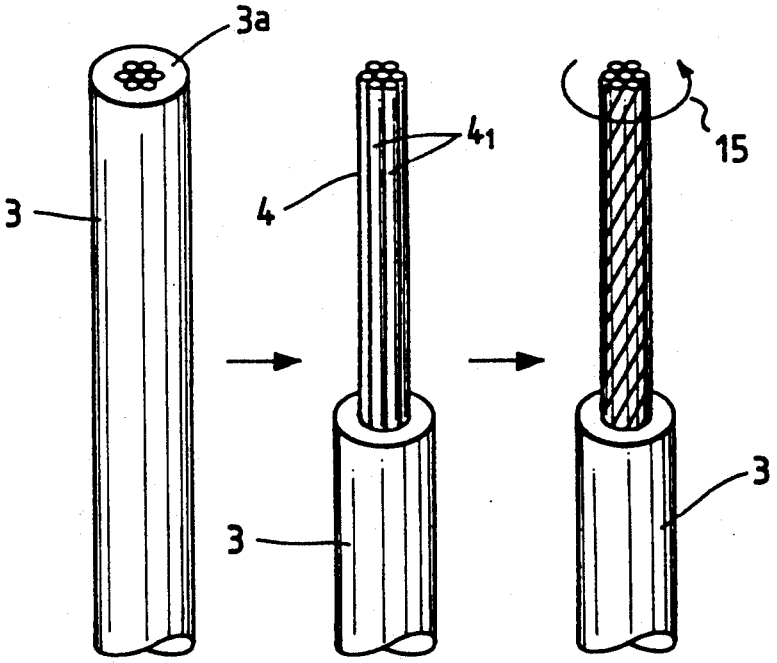
FIG. 3 is a view of the electric wire to illustrate a procedure of exposing the conductors thereof.

As shown in FIG. 3, the conductors 4 are exposed by peeling the electric insulator 3*a* of the electric wire 3 at the end thereof, and may be twisted as shown by an arrow 15, to prevent the mutual separation of the conductors to heighten the strength of the mutual binding of them.

Figure 4:
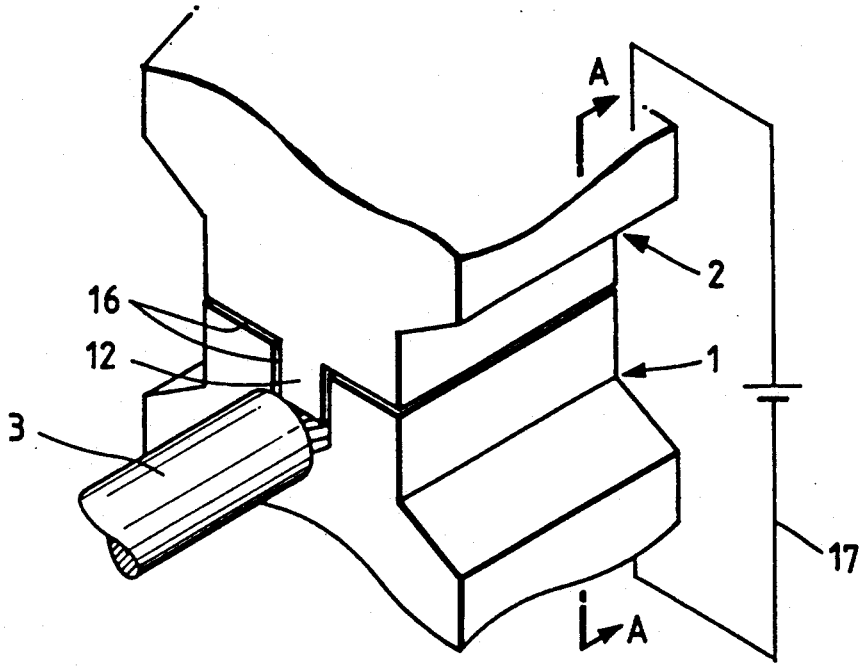
FIG. 4 is a perspective view of the unit in the state that the conductors are formed together into a terminal by the unit.
Figure 5:
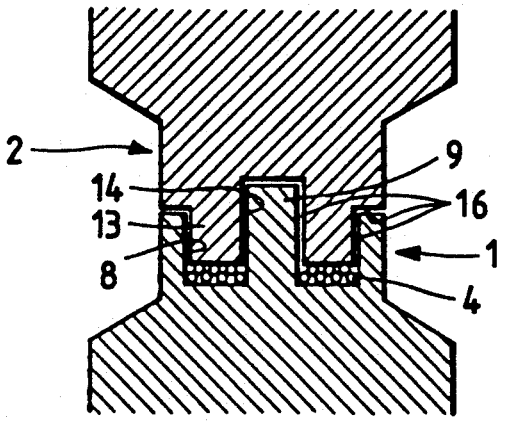
FIG. 5 is a sectional view of the unit along lines A shown in FIG. 5.

FIG. 4 is a perspective view of the forming electrode unit in the state that the conductors 4 of the wire 3 are formed together in between the female grooved pressing electrode 1 and male protuberant pressing electrode 2 of the unit. FIG. 5 is a sectional view of the unit along lines A shown in FIG. 4.

Figure 6:
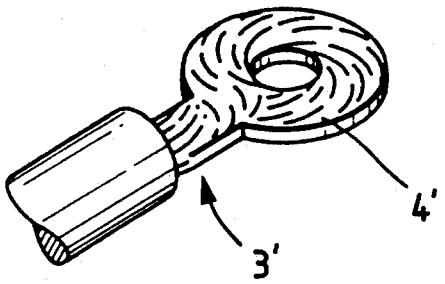
FIG. 6 is a perspective view of the electric wire formed with the terminal.
Figure 7:
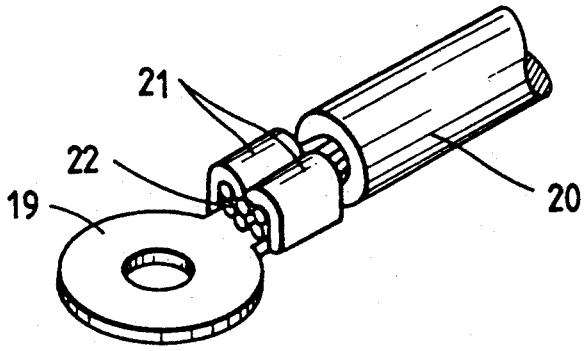
FIG. 7 is a perspective view of a conventional electric wire and a conventional terminal connected therewith.
Figure 8A:
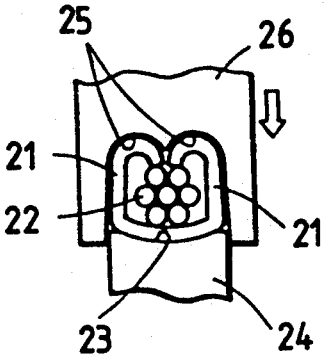
FIGS. 8(A), 8(B) and 8(C) are respective end views of the conventional electric wire and the conventional terminal to illustrate steps in a procedure of press-attaching the terminal to the wire to connect them with each other.
Figure 8B:
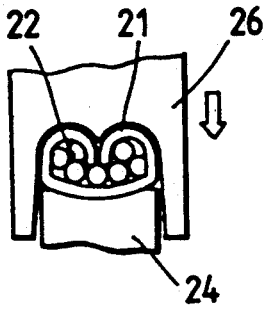
Figure 8C:
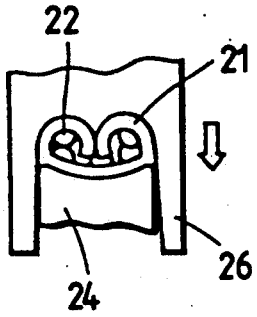
Figure 9:
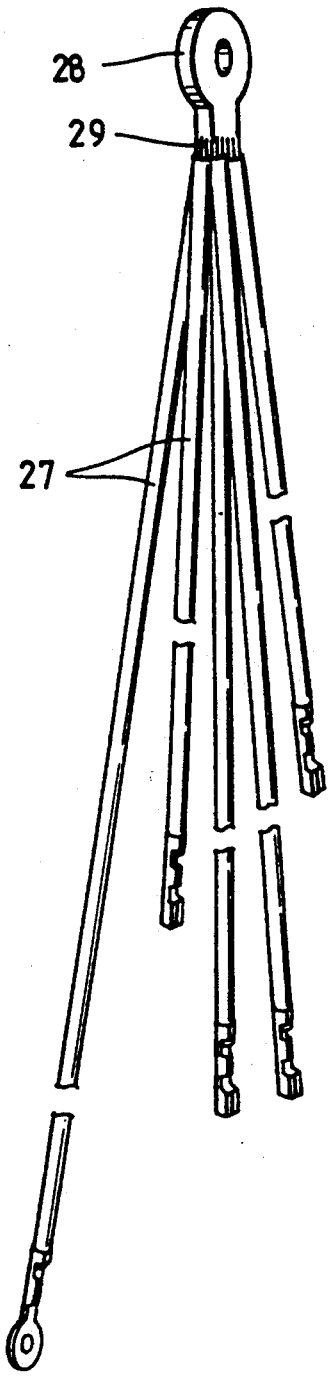
FIG. 9 is a perspective view of conventional electric wires integrally formed with a conventional terminal.

When the conductors 4 of the electric wire 3 are formed together into the terminal by the forming electrode unit, the conductors are compressed by the female grooved and male protuberant pressing electrodes 1 and 2 of the unit as the electrodes are out of contact with each other due to the clearance 16 between them. At the same time, a heavy electrical current 17 of about 7,000 to 8,000 Å is caused to flow through the conductors 4 and the electrodes 1 and 2 to heat the conductors to a temperature of 600° to 700° C. The appropriate pressure for the compression is bout 210 to 360 kg/mm$^2$ in the case that the diameter of each $4_1$ of the conductors 4 is 0.32 mm and the number of them is 16. Since the conductors 4 are heated, they are softened to facilitate the compression. Since the conductors 4 are pressed by the electrode unit, the conductors harden after the compression. The electric wire 3 is thus changed into an electric wire 3' provided with the solidly compressed terminal 4', as shown in FIG. 6.

According to the present invention, the conductors of an electric wire are compressed by a forming electrode unit as the conductors are softened by heating. For that reason, the conductors can be easily and surely formed together into a terminal of enough strength so that the electric wire is integrally provided with the terminal.

What is claimed is:

1. A method of forming an electrode unit comprising the steps of:

setting a conductor of electric wire in an electric wire housing groove of a female pressing electrode in such a manner that said conductors are wound on a guide pin of said female pressing electrode;

compressing said conductor by supplying said female pressing and a male pressing electrodes with compression; and heating said conductors by applying an electric current to said female pressing and said male pressing electrodes.

2. A method of forming an electrode unit as claimed in claim 1, wherein said female pressing electrode comprises a tip portion having said electric wire housing groove which includes an annular portion and a straight portion.

3. A method of forming an electrode unit as claimed in claim 2, wherein said male pressing electrode comprises an tip portion having a pressing portion including an annular portion and a straight portion.

4. A method of forming an electrode unit as claimed in claim 1, wherein said heating and compressing steps are simultaneously performed.

5. A method of forming an electrode unit as claimed in claim 1, wherein said guide pin is erected at the center of said electric wire housing groove.

6. A method of forming an electrode unit as claimed in claim 3, wherein said annular and said straight portion of said male pressing electrode corresponds to that of said female pressing electrode.

7. A method of forming an electrode unit as claimed in claim 3, wherein an outside diameter of said annular portion of said pressing portion is smaller than that of said electric wire housing groove.

8. A method of forming an electrode unit as claimed in claim 3, wherein a width of said straight portion of said pressing portion is smaller than that of said electric wire housing groove.

9. A method of forming an electrode unit as claimed in claim 3, wherein a diameter of said insertion hole provided with said tip portion is larger that of said guide pin.

10. A method of forming an electrode unit as claimed in claim 3, wherein a clearance is defined between said pressing portion of said male pressing electrode and said tip portion of said female pressing electrode.

11. A method of forming an electrode unit as claimed in claim 1, wherein said electrical current is in a range of 7000 to 8000 Å.

12. A method of forming an electrode unit as claimed in claim 1, wherein said compression is in a range of 210 to 360 Kg/mm$^2$.

13. A method of forming an electrode unit as claimed in claim 1, wherein said electrode is heated from 600° to 700° C.

14. A method of forming an electrode unit as claimed in claim 1, wherein said conductors are twisted.

15. A method of forming an electorde unit as claimed in claim 1, wherein said female and male pressing electrodes are made of tungsten.

* * * * *